US006243869B1

(12) United States Patent
Ekovich

(10) Patent No.: US 6,243,869 B1
(45) Date of Patent: Jun. 12, 2001

(54) FOOD SUPPORTING APRON

(76) Inventor: Steven M. Ekovich, 1075 Tavistock Dr., Tampa, FL (US) 33626

( * ) Notice: Subject to any disclaimer, the term of this patent is extended or adjusted under 35 U.S.C. 154(b) by 0 days.

(21) Appl. No.: 09/332,376

(22) Filed: Jun. 14, 1999

(51) Int. Cl.[7] ..... A41B 13/10; A41D 13/04
(52) U.S. Cl. ..... 2/48; 2/46
(58) Field of Search ..... 2/46, 48, 49.1, 2/49.2, 49.3, 49.4, 49.5, 50, 51, 52, 102

(56) References Cited

U.S. PATENT DOCUMENTS

| | | | | |
|---|---|---|---|---|
| 114,366 | * | 5/1871 | Thomson | 2/49.2 |
| 1,970,307 | * | 8/1934 | Hartmann | 2/48 |
| 2,265,690 | * | 12/1941 | Fiedler | 2/48 |
| 2,442,293 | * | 5/1948 | Hudson | 2/49 |
| 4,114,199 | * | 9/1978 | Malan | 2/49 A |
| 4,887,315 | | 12/1989 | Bezdek | 2/49 |
| 4,985,932 | | 1/1991 | Bezdek | 2/49 |
| 5,056,159 | * | 10/1991 | Zemke, Jr. | 2/46 |
| 5,062,558 | * | 11/1991 | Stang | 2/49.2 |
| 5,075,897 | * | 12/1991 | Daniels | 2/48 |
| 5,181,275 | | 1/1993 | Spulgis | 2/48 |
| 5,220,692 | | 6/1993 | Cox | 2/48 |
| 5,285,940 | * | 2/1994 | Goulter | 2/49.2 |
| 5,377,359 | * | 1/1995 | Jiang | 2/48 |
| 5,530,968 | | 7/1996 | Crockett | 2/46 |
| 5,671,479 | | 9/1997 | Dedrick | 2/46 |
| 5,701,605 | | 12/1997 | Bowen | 2/49.1 |
| 5,778,450 | | 7/1998 | Hagestad et al. | 2/49.3 |
| 5,956,763 | * | 9/1999 | Blackshear | 2/50 |

* cited by examiner

*Primary Examiner*—Amy B. Vanatta
(74) *Attorney, Agent, or Firm*—Baker, Donelson, Bearman & Caldwell

(57) ABSTRACT

An apron (10) is provided having a lap panel (11) and a torso panel (12). The lap panel has a foldable, rigid lap plate (17) which may be folded or maintained in a planar, locked position by a locking mechanism (40). The lap panel also has three peripheral pouches (32), (33), and (34) which aid in capturing waste.

16 Claims, 4 Drawing Sheets

FOOD SUPPORTING APRON

TECHNICAL FIELD le;2qThis invention relates to aprons, and specifically to aprons which are worn by a wearer in a seated position so as to support food thereon.

BACKGROUND OF THE INVENTION le;2qIt is common to consume food and beverages in a seated position. Typically, the food is supported upon a table under which the legs of a consumer are positioned. As such, the table provides a rigid support structure which is unencumbered by movement of the consumer.

le;2qToday however, many consumers eat their meals while seated or even driving in their cars. Such a situation does not lend itself to the use of a table. Therefore, some consumers have simply utilized a napkin positioned upon their lap to protect the lap from spills associated with the food items. This however does not protect the upper torso from spills.

le;2qAprons have been designed which protect not only the lap area but also the upper torso of a consumer in a seated position, as shown in U.S. Pat. No. 5,220,692. These aprons are typically made of a flexible sheet material. While these aprons provide protection from spills they are not designed to support food thereon in a stable manner.

le;2qAprons have also been designed which incorporate a tray designed to support food, as shown in U.S. Pat. No. 5,671,479. These trays however are not designed to collect the spilled food once a consumer has finished his or her meal. As such, crumbs or the like are likely to fall to the side of the consumer when the apron is removed.

le;2qAccordingly, it is seen that a need remains for an apron which not only protects a consumer from spillage but also collects the spilled food. It is to the provision of such therefore that the present invention is primarily directed.

SUMMARY OF THE INVENTION le;2qIn a preferred form of the invention an apron comprises a torso panel and a lap panel extending from the torso panel, both of which are made of a flexible sheet material. A lap plate configured to be reciprocally folded along a fold between a folded condition and a generally, planar, unfolded condition is coupled to the lap panel. The apron also includes lock means for locking the lap plate in the unfolded condition and unlocking the lap plate to allow the lap plate to be moved to a folded condition. With this construction and with the lap plate in its locked, unfolded condition the apron lap panel is provided with an underlying rigid, planar surface upon which items may be supported, and whereby with the unlocking of the lap plate the lap panel may be folded to gather and confine waste upon the lap panel.

Figure 1:
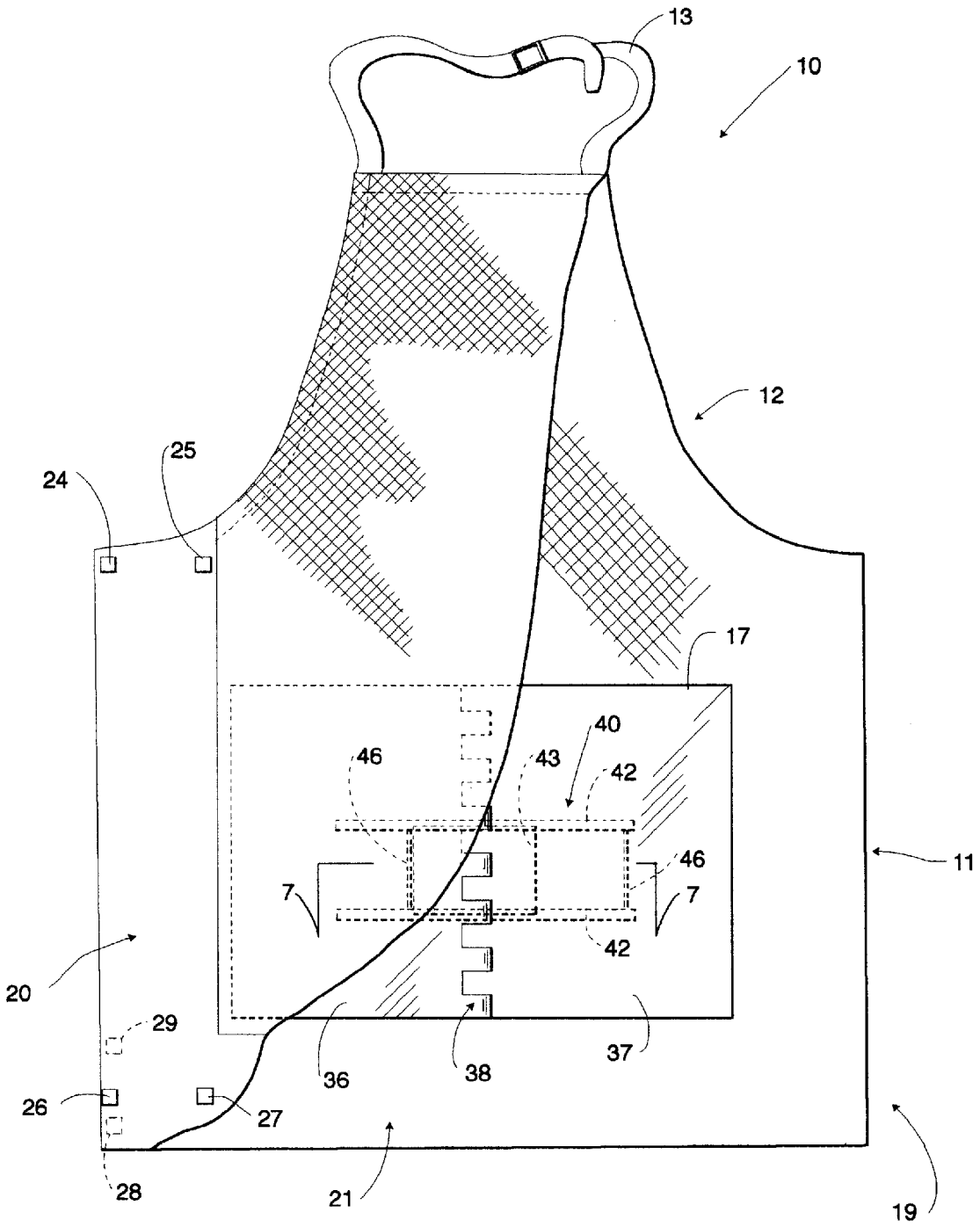

BRIEF DESCRIPTION OF THE DRAWINGS le;2qFIG. 1 is a plan view of an apron embodying principles of the present invention in a preferred form.

le;2qFIG. 2 a perspective view of the apron of FIG. 1, shown worn by a consumer.

le;2qFIG. 3 is a perspective view of the apron of FIG. 1, shown being folded.

le;2qFIGS. 4–6 are a sequence of plan views showing the apron of FIG. 1, which show in sequence, the apron being folded.

le;2qFIG. 7 is a front view of a portion of the apron of FIG. 1 taken along plane 7—7.

le;2qFIG. 8 is a front view of an apron in another preferred embodiment.

Figure 2:
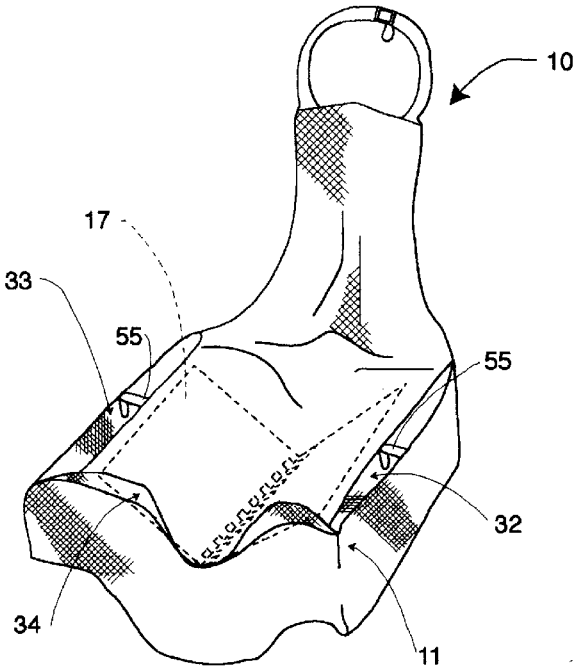
Figure 3:
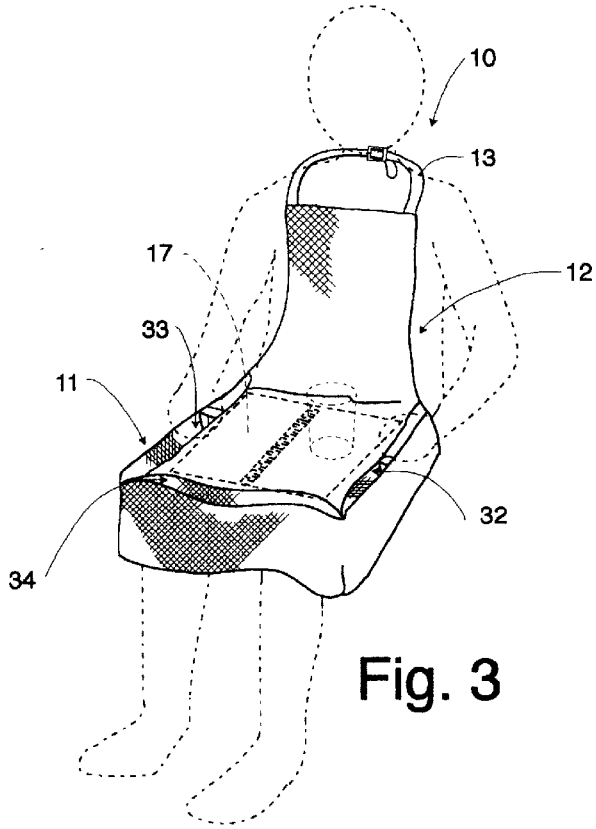
Figure 4:
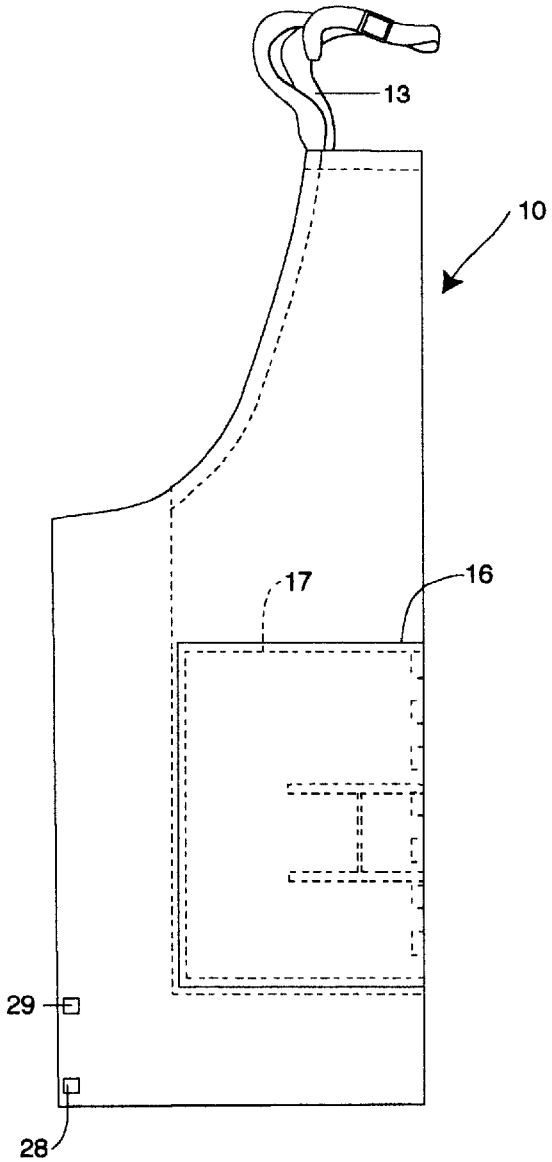
Figure 5:
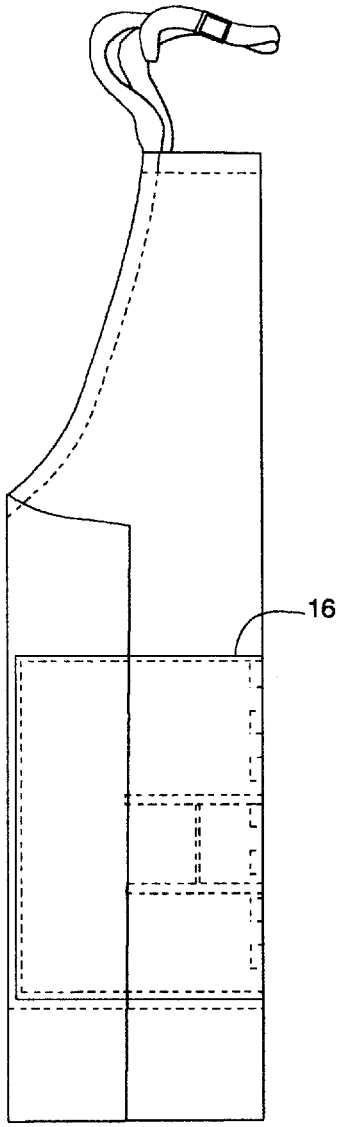
Figure 6:
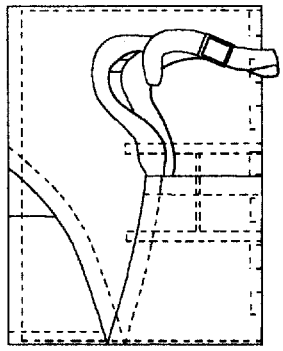
Figure 7:
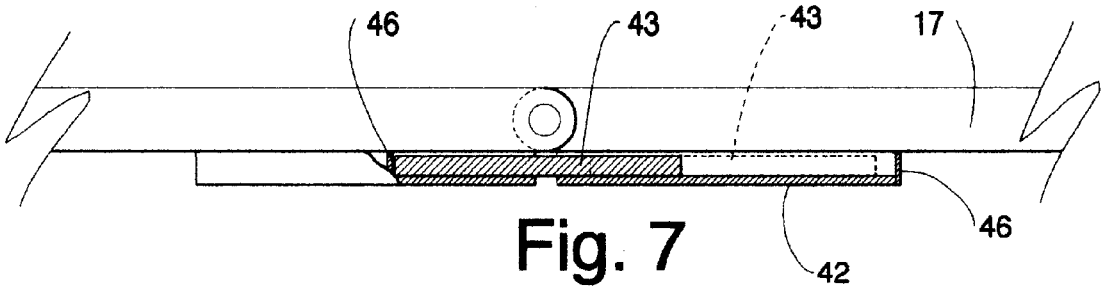
Figure 8:
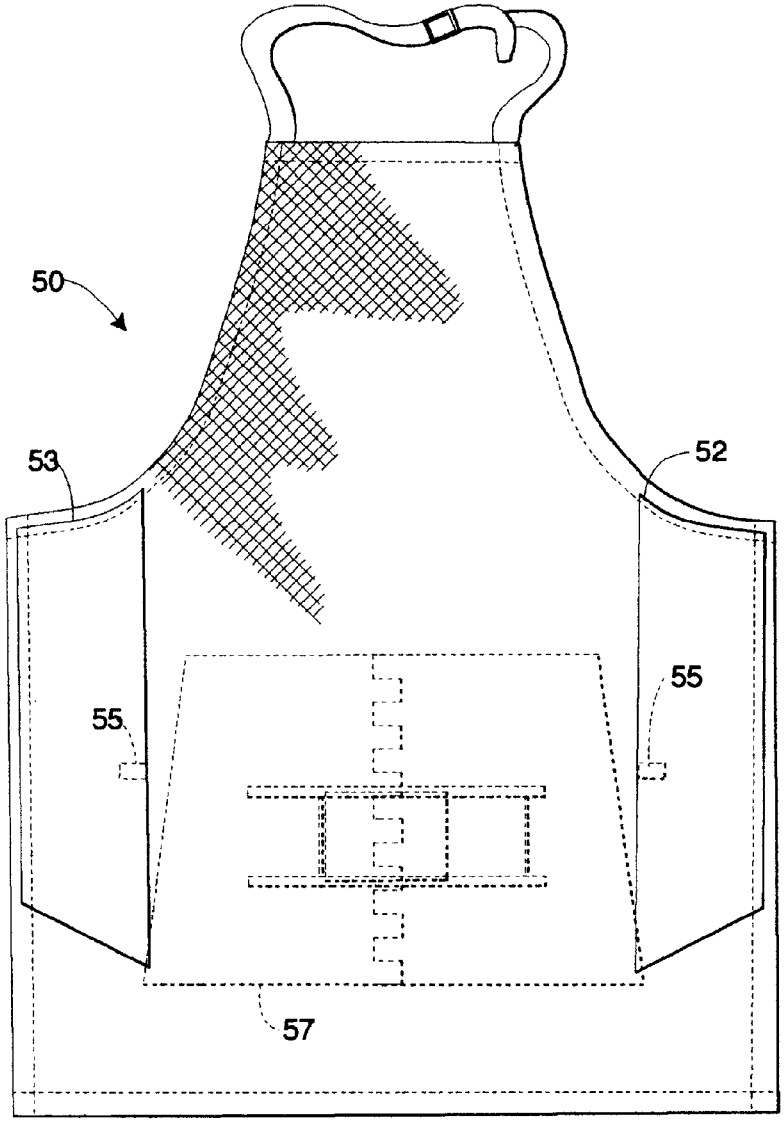

DETAILED DESCRIPTION le;2qWith reference next to the drawings, there is shown an apron 10 having a lap panel 11 and a co-extending torso panel 12, the lap panel 11 and torso panel 12 being made of a flexible sheet material. The torso panel 12 includes an adjustable neck strap 13.

le;2qThe lap panel 11 has a sleeve 16 in which a lap plate 17 is removably mounted through an unshown closeable end opening in the sleeve. The lap plate 17 is of a size and shape so that the lap panel 11 includes a right side margin 19, a left side margin 20, and a bottom margin 21 all extending beyond the peripheral edges of the underlying lap plate. The right and left margins 19 and 20 each include a first pair of mating hook and loop type fasteners 24 and 25, and a second pair of hook and loop type fasteners 26 and 27. Two third pairs of hook and loop type fasteners 28 and 29 are mounted to the lap panel with one fastener 28 of each pair mounted to the underside of the lap panel generally opposite and above second fastener 26 and the other fastener 29 of each pair mounted to the underside of the bottom margin 21 adjacent the lower corner. With the fasteners 24, 25, 26, 27, 28, and 29 all mateably coupled, the lap panel 11 is folded so that the right side margin 19 forms a right edge pouch 32, the left side margin 20 forms a left edge pouch 33, and the bottom margin 21 forms a bottom edge pouch 34. The pouches 32, 33 and 34 all have top openings adjacent the edge of the lap plate 17.

le;2qThe lap plate 17 has a left portion 36 and a right portion 37 coupled to the left portion 36 along a hinge 38. A locking mechanism 40 is mounted to the left and right portions 36 and 37 which allows relative hinged movement while in the unlocked position but prevents hinged movement while in the locked position. The locking mechanism includes a pair of bifurcated guide rails 42 and a locking plate 43 mounted for reciprocal movement along the guide rails 42. A pair of stops 46 limit the longitudinal movement of the locking plate 43 along the rails 42. The locking plate 43 is accessible through an unshown finger opening extending through sleeve 16.

le;2qIn use, a consumer dons the apron 10 similarly to conventional aprons with the neck strap 13 wrapped about the neck, the torso panel 12 draped over the torso and the lap panel 13 draped over the lap. With the locking plate 43 in its locking position, as shown in FIG. 7, the lap plate 17 provides a rigid supporting upon the lap of the seated consumer, allowing food to be supported thereon. The respective mating of the first, second and third pair of fasteners provide the peripheral side and bottom pouches depending down from and about the underlying lap plate and about the lap of a consumer.

le;2qShould the consumer eating a meal produce crumbs, or other types of waste or spills, such crumbs will land upon the torso or lap panels of the apron rather than upon the consumer's clothing. These crumbs may then naturally roll off the portion of the lap panel overlying the lap plate or be manually brushed off this portion and into either the peripheral bottom pouch 34 or one of the peripheral side pouches 32 or 33. As such, the apron collects the crumbs rather than allowing them to chance to roll off the apron and onto the underlying flooring or seat.

le;2qOnce the consumer has completed his or her meal the consumer may slide the locking plate 43 to its unlocked position, as shown in phantom lines in FIG. 7, thereby allowing the lap plate 17 to be folded upon itself, as shown in FIG. 2. The folding of the lap plate forces any crumbs remaining on the lap panel 11 to be gathered along the central crease C formed by the folding of the lap plate. The folding also encloses viscous spills, such as ketchup, mustard or grease, between the folds of the lap panel. As such, only the clean underside of the apron is exposed thereby preventing the exposure of the soiled material.

le;2qReferring next to FIGS. 4–6, with both the lap panel 11 and torso panel 12 folded longitudinally any crumbs on the apron are captured between the two folds, as shown in FIG. 4. The right and left side margins 19 and 20 are then wrapped about the adjacent sides edges of the lap plate to prevents crumbs from falling out from between the sides of the folded apron, as shown in FIG. 5. The bottom margin 21 is then similarly wrapped about the bottom edges of the lap plate and the torso panel wrapped about the upper edges of the lap plate, as shown in FIG. 6. It should be understood that as the lap plate is actually enclosed within the lap panel all references to wrapping the apron about the edge of the lap plate is meant to include the apron material encasing the lap panel.

le;2qAs the lap plate is mounted within sleeve 16 for easy removal, the rigid lap plate may be removed so that the remaining portion of the apron may be conventionally washed. Also, the fasteners 24, 25, 26, 27, 28 and 29 may be uncoupled to allow a thorough washing of the pouches 32, 33 and 34. Once washed, the lap plate is then reinserted into the sleeve prior to use.

le;2qReferring next to FIG. 8, there is shown an apron 50 in another preferred embodiment. Here, the apron 50 has a right edge pouch 52 and a left edge pouch 53, which are fixed rather than being releasably formed. It should also be noted that a strap 55 extends across the top edges of the pouch to prevent the outer edge of the pouch from folding down should a large amount of material be captured within the pouch, i.e. the limiting strap allows for limited opening of the pouch. The lap plate 57 has a trapezoidal shape to accommodate the legs of a person which are normally somewhat separated.

le;2qWhile this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

le;2q1. An apron comprising:

a torso panel made of a flexible sheet material;

a lap panel extending from said torso panel, said lap panel being made of a flexible sheet material;

a lap plate coupled to said lap panel, said lap plate being configured to be reciprocally foldable along a fold between a folded condition and a generally planar, unfolded condition;

lock means for locking said lap plate in said unfolded condition and unlocking said lap plate to allow said lap plate to be moved to its folded condition, whereby with the lap plate in its locked, unfolded condition the apron lap panel is provided with a rigid, planar surface upon which items may be supported, and whereby with the unlocking of the lap plate the lap panel may be folded to gather and confine waste upon the lap panel.

le;2q2. The apron of claim 1 wherein said lap panel includes an open pouch having an opening adjacent a side edge of said lap plate which captures waste falling from a portion of the lap panel overlaying said lap plate.

le;2q3. The apron of claim 1 wherein said lap panel includes a margin extending beyond said lap plate, whereby with the lap plate in its folded condition generally folded upon itself the margin may be wrapped about the folded edge of the lap plate to capture waste material gathered between the folded lap plate.

le;2q4. The apron of claim 3 wherein said lap panel margin extends about a side of said lap plate.

le;2q5. The apron of claim 3 wherein said lap panel margin extends about a front edge of said lap plate.

le;2q6. The apron of claim 5 wherein said lap panel margin also extends about a side of said lap late.

le;2q7. The apron of claim 1 wherein said lap panel is formed with a sleeve adapted to hold said lap plate.

le;2q8. The apron of claim 2 wherein said pouch includes means for limiting the size of said pouch opening.

le;2q9. An apron comprising:

a torso panel made of a flexible sheet material;

a lap panel extending from said torso panel, said lap panel being made of a flexible sheet material, said lap panel including an open pouch having an opening adjacent a peripheral edge of said lap panel which captures waste falling from a central portion of the lap panel; and a lap plate coupled to said lap panel, said lap plate being configured to be foldable along a fold between a folded condition and an unfolded condition, and lock means for locking said lap plate in said unfolded condition and unlocking said lap plate to allow said lap plate to be moved to its folded condition, whereby with the lap plate in its locked, unfolded condition the apron lap panel is provided with a rigid, planar surface upon which items may be supported, and whereby with the unlocking of the lap plate the lap panel may be folded to gather and confine waste upon the lap panel.

le;2q10. The apron of claim 9 wherein said lap panel includes a margin extending beyond said lap plate, whereby with the lap plate in its folded condition generally folded upon itself the margin may be wrapped about the folded edge of the lap plate to capture waste material gathered between the folded lap plate.

le;2q11. The apron of claim 10 wherein said lap panel margin extends about a side of said lap plate.

le;2q12. The apron of claim 10 wherein said lap panel margin extends about a front edge of said lap plate.

le;2q13. The apron of claim 12 wherein said lap panel margin also extends about a side of said lap plate.

le;2q14. The apron of claim 9 wherein said lap panel includes a sleeve adapted to hold said lap plate.

le;2q15. An apron comprising:

a torso panel made of a flexible sheet material;

a lap panel extending from said torso panel, said lap panel being made of a flexible sheet material;

a lap plate coupled to said lap panel, said lap plate being configured to be foldable along a fold between a folded condition and an unfolded condition, said lap plate having a size and shape smaller than said lap panel so as to create a lap panel margin extending beyond said lap plate; and lock means for locking said lap plate in said unfolded condition and unlocking said lap plate to allow said lap plate to be moved to its folded condition, whereby with the lap plate in its locked, unfolded condition the apron lap panel is provided with a rigid, planar surface upon which items may be supported, and whereby with the unlocking of the lap plate the lap panel may be folded to gather and confine waste upon the lap panel.

le;2q16. An apron comprising:

a torso panel made of a flexible sheet material;

a lap panel extending from said torso panel, said lap panel being made of a flexible sheet material; and a lap plate coupled to said lap panel, said lap plate being configured to be foldable along a fold between a folded condition and an unfolded condition, said lap plate having a size and shape smaller than said lap panel so as to create a lap panel margin extending beyond said lap plate;

said lap panel is formed with a sleeve adapted to hold said lap plate, whereby with the lap plate in its locked, unfolded condition the apron lap panel is provided with a rigid, planar surface upon which items may be supported, and whereby with the unlocking of the lap plate the lap panel may be folded to gather and confine waste upon the lap panel.

* * * * *